United States Patent [19]

Gibbs et al.

[11] Patent Number: 4,601,391

[45] Date of Patent: Jul. 22, 1986

[54] VENTILATED FABRIC COVER FOR STRINGED INSTRUMENTS

[76] Inventors: Richard Gibbs; Robert J. Reynolds; Kevin Greenhaw, all of 301 W. 122nd St., Los Angeles, Calif. 90061

[21] Appl. No.: 699,721

[22] Filed: Feb. 7, 1985

[51] Int. Cl.[4] ..... A45C 11/00

[52] U.S. Cl. ..... 206/314; 206/14; 150/52 R

[58] Field of Search ..... 150/52 R; 206/314, 14

[56] References Cited

U.S. PATENT DOCUMENTS

| | | | |
|---|---|---|---|
| D. 278,442 | 4/1985 | Whomsley | 150/52 R |
| 1,446,563 | 2/1923 | Hughes | 150/52 R |
| 2,501,844 | 3/1950 | Ervin | 150/52 R |
| 2,763,428 | 9/1956 | Selah | 150/52 R |
| 3,251,258 | 5/1966 | Parker | 150/52 R |
| 3,729,037 | 4/1973 | Dare et al. | 150/52 R |
| 3,766,954 | 10/1973 | Gentellalli | 150/52 R |
| 3,877,501 | 4/1975 | Toth | 150/52 R |
| 3,921,768 | 11/1975 | Gorky | 150/52 R |
| 4,000,678 | 1/1977 | Messina | 150/52 R |
| 4,039,098 | 8/1977 | Stilts | 150/52 R |

FOREIGN PATENT DOCUMENTS 23207 of 1911 United Kingdom ..... 206/14

*Primary Examiner*—Joseph Man-Fu Moy

*Attorney, Agent, or Firm*—Frank Frisenda, Jr.

[57] ABSTRACT

The present invention provides a unique ventilated fabric cover reinforced at selected portions for protecting finishes of stringed instruments. In a presently preferred embodiment, the inventive fabric cover is composed of interlaced, natural fibers woven or knitted in a prescribed ventilated pattern, and reinforced at selective portions which are more subject to wear as the instrument is played over time. The ventilated fabric is configured to protect and surround the outer rear peripheral portion of the stringed instrument, and may be custom sized for a wide variety of guitars, violins, violas, lutes, stringed basses, cellos, or the like. The unique cover further comprises elastic banding disposed in a central portion of the fabric to effect a tensioned form fit with the outer rear peripheral portion of the instrument to be protected. Accordingly, the inventive ventilated fabric cover protects the delicate finish of stringed instruments which are easily scratched or marred, but will not adversely interfere with the acoustic quality of the sound produced by the stringed instrument.

10 Claims, 4 Drawing Figures

VENTILATED FABRIC COVER FOR STRINGED INSTRUMENTS

BACKGROUND OF THE INVENTION

This invention relates to means for protecting instruments, and more particularly, to a unique ventilated fabric cover for protecting the finish of stringed instruments having very fine, but easily scratched or marred surfaces.

It has been recognized by those skilled in the art, that instruments, particularly, stringed instruments having highly polished and/or finished surface layers, are generally subject to wear as the instrument is played by a musician over time. Typically, the base material selected for construction of the stringed instrument is carefully chosen for its acoustical qualities among which is the ability of the material to resonate. One such category of desirable materials is wood, including rosewood, spruce, indian rosewood and cedar.

The wooden base of the stringed instruments is further provided with a delicate varnish coating, which may be painstakingly applied in multiple layers to enhance the acoustical characteristics of the instrument. Such coating also provides the instrument with a highly ornamental appearance.

Among the critical components for production of an instrument of an exceptional sound quality, therefore, is the careful selection of the wooden base and correlation with the particular varnish and multiple layers applied thereto.

Generally, the stringed instrument is held by a musician with its back portion in contact with the arm and body of the musician. It is not uncommon, therefore, that the rear peripheral portion and other exposed portions of the stringed instrument rubs against the clothing of the musician. The inevitable result of such contact between the instrument and the musician over time is that buttons, belt buckles, and other notions will scratch, mar, or otherwise impair the finish delicately imparted to the wooden base.

Further, it is not uncommon for a musician to perspire, particularly during public performances. Accordingly, if the musician is in body contact with the instrument, this perspiration will adversely react with the delicate finish and deliteriously affect the originally designed acoustical quality of the instrument.

In U.S. Pat. No. 1,713,855 issued to Oettinger, there is disclosed an arm rest which also serves as a cover for a banjo. The arm rest in one embodied form, comprises a plate which may be pivoted to one of a plurality of fingers that are secured to the head of the instrument and extend radially inward as a support for the arm rest plate. The plate is stated to serve to completely guard and protect the adjusting elements of the tail piece against injury, and also to protect the clothing of the player from catching on any part of the tail piece mechanism of the banjo.

Overton, in U.S. Pat. No. 1,785,206, discloses a musical instrument and particularly, an arm rest for stringed musical instruments. In one embodied form, the Overton invention provides an arm rest, carried by the body of the instrument, and spaced therefrom and adapted to support the arm of the hand, of the player, which cooperates with the fretted finger board to control the strings when they have been plucked by the other hand of the player. In order to avoid the necessity of resting the arm directly on the body of the instrument, the arm rest is preferably plate like in form and is spaced from the instrument by short legs which are secured both to the arm rest and to the body of the instrument.

In U.S. Pat. No. 3,251,258, issued to Parker, there is disclosed a stringed instrument protector which, in one embodied form, comprises a sheet of flexible plastic material such as polyethylene to fit closely on the back and the portion of the periphery of the body of a stringed instrument adjacent to the back. The cover has anti-slip ribs and may have sheets or patches of friction material secured to the back and side of the cover to engage the clothes of the user and prevent slippage relative to the clothes.

Phillips, in U.S. Pat. No. 3,309,954, discloses a partial cover for a guitar, which may be slipped over the back of a guitar and the top member to protect the finish of the instrument. The Phillips cover may additionally provide a pocket for holding picks when not in use.

Accordingly, a significant need has been recognized by those skilled in the art in attempting to solve the problem of worh, marred, or scratched finishes of stringed instruments as they are played by a musician over time. Further, a significant need has been recognized in providing such protection, but without destroying or adversely affecting the acoustical qualities of the instrument, as it was originally designed. The present invention fulfills these needs.

SUMMARY OF THE INVENTION

This invention relates to a unique ventilated fabric cover reinforced at selected portions for protecting finishes of stringed instruments.

In one embodied form, the inventive cover comprises a fabric base composed of interlaced natural or synthetic fibers held in a prescribed ventilated pattern to provide the cover with sufficient moisture absorbency from the standpoint of preventing perspiration from deliteriously affecting the finish on the stringed instrument. The light weight fabric, however, permits breathability of the wooden base of the instrument and will not mute the sound resonance of the stringed instrument.

The unique cover further comprises means for reinforcement of the cover at selective portions which are more subject to wear as the instrument is played by a musician. Such reinforced portions are preferably composed of a relatively light weight suede or other breathable material such as fabric or porous polymers and are preferably disposed in areas of the cover which contact a musician's body as the instrument is played. The reinforced portions are appended to the fabric base in a suitable manner such as by adhesive interposed between the fabric and reinforced portions to provide a smooth interior surface of the fabric cover facing the surface portion of the instrument to be protected.

The unique cover further comprises tensioning means such as elastic bonding disposed in a central portion of the fabric base and at edge portions to effect a tensioned form fit of the cover with the surface portions of the instrument to be protected. The cover may be custom sized for a wide variety of stringed instruments, including guitars, violins, lutes, stringed basses, cellos and the like.

Accordingly, the inventive ventilated fabric cover protects the delicate finish of stringed instruments which are easily scratched or marred, but will not adversely interfere with the acoustic quality of the sound produced by the stringed instrument.

The above and other objects and advantages of the invention will become apparent from the following more detailed description of the invention, taken in conjunction with the drawings.

DESCRIPTION OF THE PREFERRED EMBODIMENTS

The present invention provides a unique ventilated fabric cover reinforced at selective portions for protecting finishes of stringed instrument.

In a presently preferred embodiment, the inventive fabric cover is composed of interlaced, natural fibres, woven or knitted in a prescribed ventilated pattern, and reinforced at selected portions which are more subject to wear as the instrument is played over time.

The ventilated fabric is configured to protect and surround the outer rear peripheral portion of the stringed instrument, and may be custom-sized for a wide variety guitars, violins, violas, lutes, stringed basses, cellos or the like.

Figure 1:
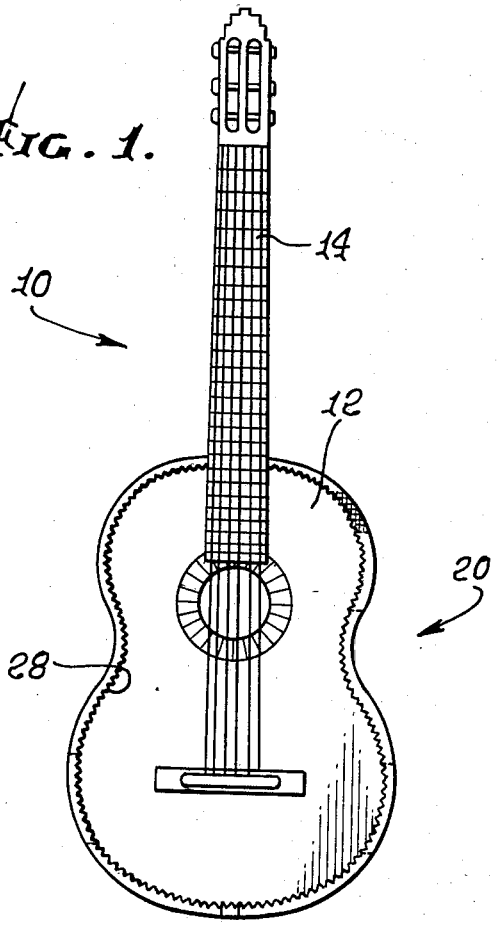
FIG. 1 is a front view of a guitar with a unique ventilated fabric cover reinforced at selective portions in accordance with one embodiment of the present invention.
Figure 2:
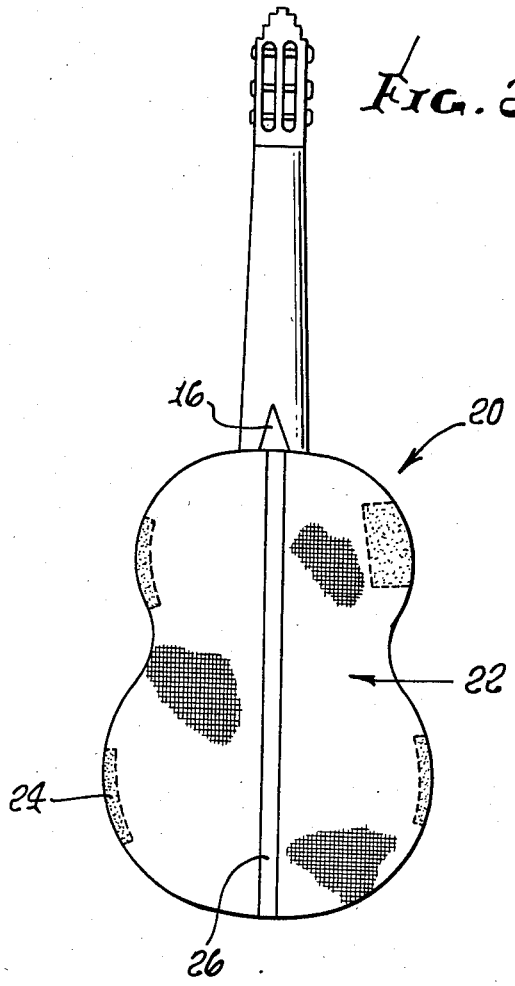
FIG. 2 is a rear view of the guitar shown in FIG. 1 with appended unique ventilated fabric cover in accordance with one embodiment of the present invention.

Referring now to FIG. 1, there is shown a conventional classical guitar 10 having a wooden base 12, neck portion 14 and heel 16 (FIG. 2).

Those generally skilled in the art, will readily appreciate that although the figures of the application depict one stringed instrument, namely, a guitar, the unique ventilated fabric cover is readily adaptable to integrate with a wide variety of instruments, and will be readily modified to be appropriately configured for the periphery of the instrument to be protected. Similarly, the reinforced portions of the inventive cover will be suitably disposed in areas which are more subject to wear as the instrument is normally held by a musician during performance. For instance, a steel string acoustic guitar will have a reinforced portion of the cover located on the back face of the cover and suitably disposed to protect the guitar from the musician's belt-buckle.

Figure 3:
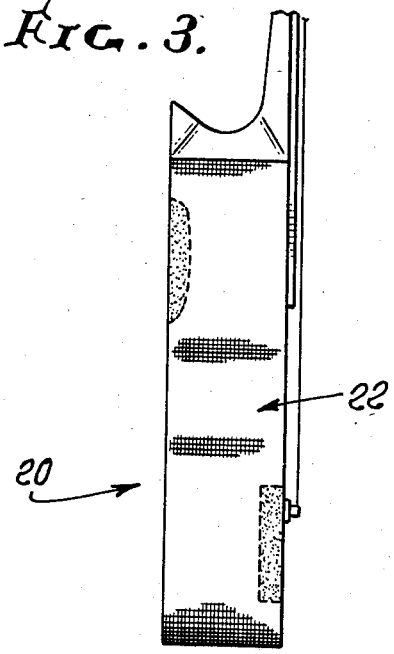
FIG. 3 is a side view of a top portion of the guitar with appended ventilated fabric cover illustrated in FIG. 1.
Figure 4:
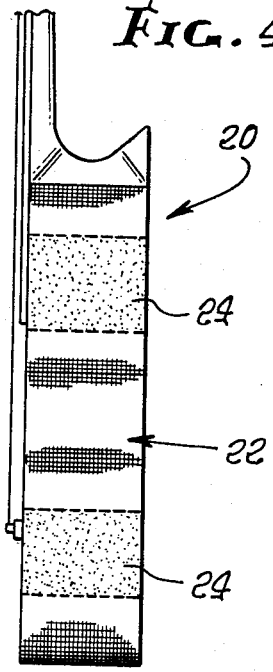
FIG. 4 is a side view of a bottom portion of the protected guitar shown in FIG. 1.

The inventive cover, generally denoted 20, is seen more clearly in FIGS. 2, 3 and 4 which depict the rear surface, and side portions (top and bottom) of the covered guitar 10 illustrated in FIG. 1.

The inventive cover 20 may generally be described as having a fabric base 22 configured to protect and surround the outer sides and rear peripheral portion of the guitar 10.

The fabric base 22 is composed of interlaced fibers in a prescribed ventilated pattern, described more fully below, and reinforced at selective portions 24 (typically in body contact with the musician) which are more subject to wear as the instrument is played over time.

In one embodied form, the fabric base is woven from two sets of threads that cross each other at right angles in an open-weave, that is, interstices, between threads greater than/or equal to the average mean diameter of the warp and weft threads. The warp threads (ends) run through the length of the fabric while the weft threads (picks) interlace across the warp to form a web.

An important characteristic of the fabric base 22 is that it provides sufficient moisture absorbency from the standpoint of protecting the instrument from the deliterious effects of perspiration. However, the fabric base 22 must not adversely interferewith the acoustic quality of the sound produced by the instrument. Accordingly, the pattern and weight of the fabric base 22 must be carefully selected to provide strength, abrasion resistance, and handle. In this respect, the cloth density, i.e., interstices of the warp and weft threads and the way in which they are interlaced (the weave construction) is an important characteristic of the unique fabric cover of the present invention.

The yarn count of the fabric base 22 expresses the thickness of the yarn. The yarn-count number indicates the length of the yarn in relation to the weight. The Tex count represents the wright in grams per one kilometer of yarn, i.e., a yarn numbered 10 Tex measures one kilometer and weights 10 grams. The Tex number increases with the size of the yarn.

Accordingly, the number of ends and picks in a measured unit of cloth is called the "setting", and the setting of the cloth depends on the following inter-related factors:

(1) The weave construction, i.e., the number of thread intersections there are within the repeat unit;

(2) The yarn count (size);

(3) The character and texture of the yarn;

(4) Whether or not the cloth will undergo a finishing process that causes shrinkage.

In accordance with the present invention, it is preferred that the fabric base 22 be of light weight construction and composed of natural fibers, the fabric 22 having a relatively large interstices between the warp and weft threads.

Those skilled in the art will readily appreciate the appropriate "setting" of the cloth to be utilized as the fabric base 22. In this regard, the following disclosures are hereby incorporated by this reference: Black, Mary KEY TO WEAVING published by the Bruce Publishing Company (1949); Straub, Marianne—HAND WEAVING AND CLOTH DESIGN, published by Viking Press (1977); and Wilson, Jean—WEAVING YOU CAN WEAR, published by Van Nostrand Reinhold Company (1973).

As shown in FIGS. 2 and 4, the reinforced portions 24 provided on the fabric base 22 are preferably provided in two areas of the bottom of the base 22 which will normally contact leg portions of a seated musician.

As seen most clearly in FIG. 2, the inventive cover 20 further comprises elastic banding 26 or other tensioning means disposed in a central portion of the fabric base 22 to effect a tensioned form fit of the cover 20 with the outer sides and rear peripheral portion of the instrument to be protected. The elastic banding 28 (FIG. 1) or other suitable tensioning means may further be conveniently disposed in the marginal portions of the cover 20 to further enhance the form fit of the cover 20 with the instrument.

The reinforced portions 24 and elastic banding 26 and 28 are appended to the fabric base 22 in a manner to provide a smooth interior surface applied against the outer portion of the instrument to be protected. In an alternative embodiment, the elastic banding 28 may be replaced by a drawstring means, suitably integrated with the instrument so as not to interfere with its strings.

As previously mentioned, the cover 20 will be customsized to fit a wide variety of stringed instruments, including guitars, violins, violas, lutes, stringed basses, cellos and the like.

FIGS. 2 and 3 depict the top portion of the guitar 10 with inventive cover 22 thereon. As shown, the cover 22 is sized to extend around the neck portion of the guitar 10, and an opening is provided for the heel 16 of the guitar 10. The cover 22 has reinforced portions 24 suitably disposed in upper areas to prevent excessive wear by the musician's chest and arm which normally make contact with the guitar as the instrument is played.

While the foregoing description refers to weaving of the fabric base 22, those skilled in the art will readily appreciate the interlaced threads may also be knitted, heat sealed, or joined in other manners to provide suitable protection and a sufficient number of interstices between the fibres so as not to mute the sound quality of the instrument as it is played.

Preferably, the material for constructing the fabric base 22 is a natural cotton fibre or yarn. Cotton is particularly desirable, in that it is relatively lightweight, and possesses moisture absorbency to prevent perspiration from deliteriously affecting the finish of the stringed instrument. Other fibres suitable for this purpose include flax, and combinations of cotton and flax.

Accordingly, the inventive ventilative fabric cover 20 protects the delicate finish of stringed instruments which are easily scratched or marred, but will not adversely interfere with the acoustic quality of the sound produced by the stringed instrument as it is played.

While particular forms of the invention are described above, it will be understood that the described invention is capable of further modifications and variations for adaptations of the invention. Accordingly, it is not intended that the invention be in any way limited, except as by the appended claim.

We claim:

1. A ventilated fabric cover composed of warp and weft fibers reinforced at selective portions for protecting delicate finish of a stringed instrument, having a front, side and rear peripheral outer surface, said ventilated fabric cover comprising:

a fabric base having a prescribed ventilated weave comprising interlaced moisture absorbent fibers; said prescribed ventilated weave having a sufficient number of interstices between adjacent fibers at least equal to the average mean diameter of said warp and weft fibers to prevent substantial muting of sound quality of the instrument as it is played; said fabric base being configured to extend about and surround the outer side and rear peripheral surfaces of the stringed instrument;

means for reinforcing said fabric base at selective portions which typically contact body portions of a musician as said instrument is played;

means for tensioning said fabric base to effect a form fit with the outer surfaces of said instrument to be protected; said means for tensioning being disposed in a central portion of said fabric base and disposed at marginal edges of said fabric base;

wherein when said ventilated fabric cover is extended about said stringed instrument to surround the outer side and rear periphery, said cover provides protection of the delicate finish of the instrument against perspiration and marring, but will not adversely interfere with acoustical quality of sound from the instrument.

2. The ventilated fabric cover as defined in claim 1 wherein said means for tensioning comprises elastic banding disposed in a central portion of said fabric base.

3. The ventilated fabric cover as defined in claim 1 wherein said moisture absorbant fibers are composed of cotton.

4. The ventilated fabric cover as defined in claim 1 wherein said moisture absorbant fibers are composed of flax.

5. The ventilated fabric cover as defined in claim 1 wherein said means for reinforcing said fabric base comprises natural suede patches appended to said fabric base.

6. The ventilated fabric cover as defined in claim 1 wherein said means for reinforcing said fabric base comprises porous polymeric material patches appended to said fabric base.

7. The ventilated fabric cover as defined in claim 1 wherein said means for reinforcing said fabric base is appended on said fabric base by means of adhesive interposed between said means and said fabric base.

8. The ventilated fabric cover as defined in claim 1 wherein said stringed instrument is an instrument selected from the group consisting of guitars, violins, violas; lutes, string basses, and cellos.

9. The ventilated fabric cover as defined in claim 1 wherein said fabric base is woven from two sets of threads that cross each other at right angles in an open-weave.

10. The ventilated fabric cover as defined in claim 9 wherein said fabric base comprises interlaced threads having interstices between threads greater than/or equal to the average mean diameter of warp and weft threads comprising said fabric.

* * * * *